United States Patent [19]

Matsuda et al.

[11] 4,225,662

[45] Sep. 30, 1980

[54] DIAZO COPYING MATERIAL

[75] Inventors: Tsutomu Matsuda; Masanori Rimoto, both of Numazu; Chihiro Hayashi, Osaka, all of Japan

[73] Assignee: Ricoh Company, Ltd., Tokyo, Japan

[21] Appl. No.: 29,060

[22] Filed: Apr. 11, 1979

[30] Foreign Application Priority Data

Apr. 14, 1978 [JP] Japan ..... 53-43286

[51] Int. Cl.[2] ..... G03C 1/58

[52] U.S. Cl. ..... 430/173; 430/148; 430/182

[58] Field of Search ..... 96/91 R, 75, 49; 260/239 BD, 141 R; 430/173, 182, 148

[56] References Cited

U.S. PATENT DOCUMENTS

| | | | |
|---|---|---|---|
| 1,989,065 | 1/1935 | Schmidt et al. | 96/91 R |
| 2,212,959 | 8/1940 | Schmidt et al. | 96/91 R |
| 2,537,098 | 1/1951 | Slifkin et al. | 96/91 R |
| 2,537,106 | 1/1951 | Von Glahn et al. | 96/91R |
| 2,548,845 | 4/1951 | Neuman | 96/91 R |
| 2,688,543 | 9/1954 | Von Glahn et al. | 96/91 R |
| 3,408,203 | 10/1968 | Sus et al. | 96/91 R |
| 3,679,420 | 7/1971 | Yokoyama | 96/91 R |
| 3,785,826 | 1/1974 | Slimowicz et al. | 96/91R |
| 3,875,142 | 4/1975 | Yomamoto et al. | 260/239 BD |

FOREIGN PATENT DOCUMENTS

| | | | |
|---|---|---|---|
| 937510 | 9/1963 | United Kingdom | 96/91 R |

OTHER PUBLICATIONS

Dinaburg M.S., "Photosensitive Diazo cpds", The Focal Press, 1964, p. 106-107.

Koser J., "Light-Sensitve Systems", J. Wiley & Sons, 1965, p. 242, 243 and 247.

Londau, R., "Foscicules 9 & 17", Dist. Andrews Paper Co., 1962, p. 62, 78 and 79.

Classification Definitions, USPTO.

*Primary Examiner*—Charles L. Bowers, Jr.

*Attorney, Agent, or Firm*—Blanchard, Flynn, Thiel, Boutell & Tanis

[57] ABSTRACT

This invention provides yellow-developing couplers for use in diazo copying materials, which couplers are superior in light fastness and are expressed by the general formula:

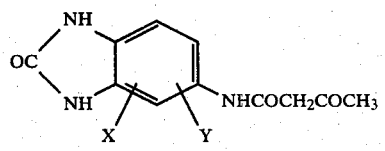

wherein X and Y represent hydrogen atom, halogen, or alkyl radical or alkoxy radical having 1 to 6 carbon atoms.

5 Claims, No Drawings

DIAZO COPYING MATERIAL

BACKGROUND OF THE INVENTION (a) Field of the Invention

This invention relates to yellow-developing couplers for use in diazo copying materials.

(b) Description of the Prior Art

General diazo copying materials are classified into the one-component type (unitary) copying material containing a diazo compound in the photosensitive layer thereof and the two-component type (binary) copying material containing both a diazo compound and a coupler in the photosensitive layer thereof. As is well known, in the case of the former copying material, it is exposed to light after superposing an original thereon and is thereafter developed with an alkaline liquid developer containing a coupler, and in the case of the latter copying material, it is exposed to light in the same fashion and is thereafter developed with an alkaline liquid developer not containing a coupler.

In the prior art, in the case where such a binary diazo copying material as mentioned above is employed as a secondary original, application of a coupler capable of producing an ultraviolet-interceptive orange-yellow azo dye is prevalent. As coupler of this type, there is generally employed acetoamide derivatives, acetoacetoanilide or acetoacetonaphthalide. Besides, when this yellow-developing coupler is used jointly with a blue-developing couplers (a coupler which can produce a blue dye upon reacting with a diazo compound), there can be formed a black dye. As blue-developing coupler of this type, $\beta$-naphthol derivatives are generally employed. However, orange-yellow azo dyes obtained from acetoamide derivatives, etc., as combined with a diazo compound are generally defective in that they are inferior in light fastness, an image formed thereof would disappear when let alone in the light, or, in the case of a black dye image formed thereof, it would cause color-shift.

SUMMARY OF THE INVENTION

This invention is intended to eliminate the aforementioned defects in the prior art. The present inventors have made a series of studies on yellow-developing couplers superior in light fastness, and as a result, they have found that acetoacetoanilide derivatives having the following general formula fit the purpose of this invention.

That is, this invention is to provide couplers for use in diazo copying materials, which couplers are expressed by the general formula:

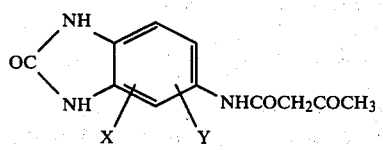

wherein X and Y represent hydrogen atom, halogen, or alkyl radical or alkoxy, radical having 1 to 6 carbon atoms.

These couplers can be applied to binary copying materials. Concrete examples of these couplers are as cited in the following but are not limited thereto:

| Compound No. | |
|---|---|
| 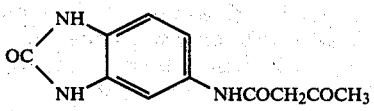 | (I) |
| 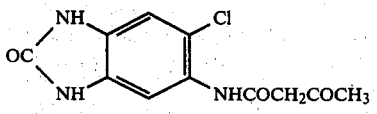 | (II) |
| 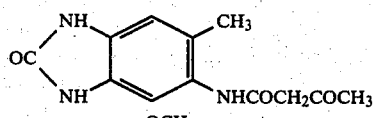 | (III) |
| 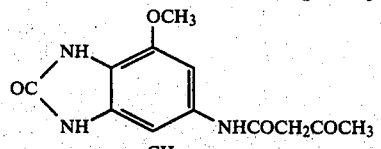 | (IV) |
| 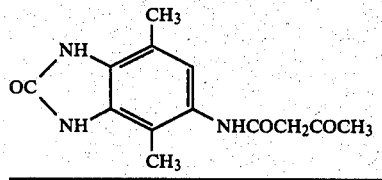 | (V) |

These compounds can be easily obtained according to, for instance, the following reaction formula:

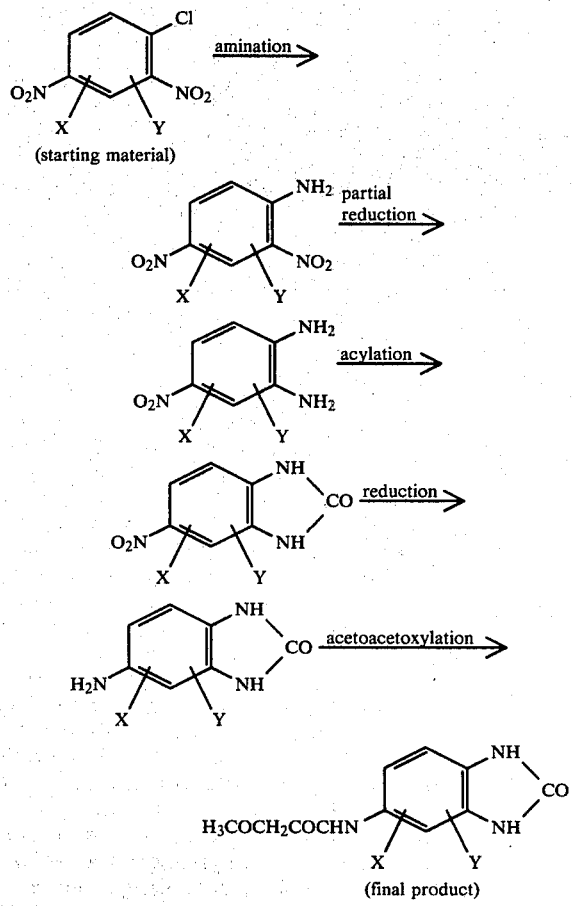

In order to synthesize, for instance, said Compound (I) according to this method, it will do to follow the procedure comprising: reacting 2,4-dinitrochlorobenzene, as a starting material, with ammonia to produce 2,4-dinitroaniline, partially reducing the 2,4-dinitroaniline to 4-nitro-0-phenylenediamine with a hydrosulfide-containing liquid thereafter, further reacting the 4-nitro-0-phenylenediamine with urea to obtain nitrobenzimidazole, reducing this nitrobenzimidazole again to obtain aminobenzimidazole, and finally acetoacetoxylating the aminobenzimidazole by means of diketene. As for Compound (II) through Compound (V), they can be prepared by applying the same method and procedure as that for Compound (I) except for the use of a substituted 2,4-dinitrochlorobenzene corresponding to each compound as a starting material.

These couplers are generally employed in an amount of 0.01 to 5 moles per 1 mole of the respective diazo compounds.

In order to obtain an orange-yellow or a sepia image, a coupler of this invention is applied either independently or upon mixing with a modicum of other color-developing couplers. In order to obtain a black image, conventional blue-developing couplers are used jointly with a coupler of this invention. As applicable blue-developing coupler, there are $\beta$-naphthol derivatives. As concrete examples of applicable $\beta$-naphthol derivatives, there can be cited 2,3-dihydroxynaphthalene, 2,3-dihydroxynaphthalene-4-sodium or potassium sulfonate, 2-hydroxynaphthalene-4-sodium sulfonate, 2-hydroxynaphthalene-7-sodium sulfonate, 2-hydroxy-3-naphthoic acid dimethylaminoethyl amide, 2-hydroxy-3-naphthoic acid diethylaminoethyl amide, 6-bromo-2-hydroxy-3-naphthoic acid diethylaminoethyl amide, 2-hydroxy-3-naphthoic acid dipropylaminopropyl amide, 6-methoxy-2-hydroxy-3-naphthoic acid dipropylaminopropyl amide, 2-hydroxy-4-naphthoic acid diethylaminopropyl amide, 6-bromo-2-hydroxy-3-naphthoic acid diethylaminopropyl amide, 2-hydroxy-3-naphthoic acid dimethylaminopropyl amide, 6-methoxy-2-hydroxy-3-naphthoic acid dimethylaminopropyl amide, 2-hydroxy-3-naphthoic acid morpholinoethyl amide, 6-bromo-2-hydroxy-3-naphthoic acid morpholinoethyl amide, 6-chloro-2-hydroxy-3-naphthoic acid morpholinoethyl amide, 2-hydroxy-3-naphthoic acid piperidinopropyl amide, 6-ethoxy-2-hydroxy-3-naphthoic acid piperidinopropyl amide, 2-hydroxy-3-naphthoic acid morpholinopropyl amide, 6-butoxy-2-hydroxy-3-naphthoic acid morpholinopropyl amide, 2-hydroxy-3-naphthoic acid amide, 2-hydroxy-3-naphthoic acid hydroxyethyl amide, 2-hydroxy-3-naphthoic acid hydroxypropyl amide, etc.

As diazo compound to be used jointly with the yellow-developing couplers of this invention, all of those compounds which are applicable to general copying materials are useful. Concrete examples of applicable compounds are as cited in the following: 4-diazo-2,5-dimethoxyphenyl morpholine, 4-diazo-2,5-diethoxyphenyl morpholine, 4-diazo-2,5-dipropoxyphenyl morpholine, 4-diazo-2,5-dibutoxyphenyl morpholine, 4-diazo-2,5-dibutoxyphenyl morpholine, 4-diazo-2,5-dibutoxy-N-benzyl-N-ethyl aniline, 4-diazo-2,5-dibutoxy-N,N-dibutyl aniline, 4-diazo-2,5-dibutoxy-N-benzyl-N-hydroxyethyl aniline, 4-diazo-2,5-dibutoxyphenyl piperidine, 4-diazo-2,5-diethoxyphenyl pyrrolidine, 4-diazo-2,5-dipropoxyphenyl piperadine, 4-diazo-N,N-dimethyl aniline, 4-diazo-N,N-diethyl aniline, 4-diazo-N-ethyl-N-hydroxyethyl aniline, 4-diazo-N,N-dipropyl aniline, 4-diazophenyl morpholine, 4-diazophenyl pyrrolidine, 4-diazo-2-methylphenyl pyrrolidine, 4-diazo-2-chloro-N,N-diethyl aniline, 4-diazo-2-ethoxy-N,N-diethyl aniline, 4-diazo-2-chlorophenyl morpholine, etc.

The couplers of this invention can be used jointly with additives applicable to the conventional diazo copying materials. That is, naphthalene-mono-, di-or tri-sodium sulfonate, aluminum sulfate, magnesium sulfate, cadmium chloride, zinc chloride, etc. as storage improver; thiourea, urea, etc. as antioxidant; caffeine, theophylline, etc. as solubilizer (an agent to facilitate the solubility of diazo compounds and the like into water); and citric acid, tartaric acid, sulfuric acid, oxalic acid, boric acid, phosphoric acid, pyrophosphoric acid, etc. as acid stabilizer are applicable. Further, a modicum of saponin can be added. Inorganic or organic white pigments such as silica and corn starch particles can also be added to the photosensitive layer or a precoating layer in order to impart writability to the photosensitive layer as well as improve image-density.

As for a support, there are paper and plastic film.

Besides, the binary copying materials containing the couplers of this invention can be applied to any conventional developing method, namely, the dry developing process employing gaseous ammonia or organic amine, the wet developing process employing alkaline aqueous solution, and the semi-dry developing process to be effected by coating a modicum of alkaline organic solution. In this context, said alkaline aqueous solution means an aqueous solution (having a pH value of 12 to 13) of either a single inorganic alkaline substance, such as potassium carbonate, potassium hydroxide, potassium tetraborate, potassium metaborate, sodium carbonate, etc., or a mixture thereof, and said alkaline organic solution means a solution obtained by dissolving an organic alkaline substance consisting of organic amine or an inorganic alkaline substance in a member of the group of solvents consisting of glycol and glycol ether.

DESCRIPTION OF THE PREFERRED EMBODIMENTS

In the following will be shown examples embodying this invention.

EXAMPLE 1

A photosensitive layer forming liquid was prepared by mixing the following ingredients:

| | |
|---|---|
| water | 100 ml |
| phosphoric acid | 2 g |
| naphthalene-1,3,6-trisodium sulfonate | 1 g |
| 2-hydroxy-3-naphthoic acid morpholinopropyl amide | 0.6 g |
| aforesaid Compound (I) | 0.2 g |
| 4-diazo-2,5-dibutoxyphenyl morpholine | 2 g |
| chloride . $\frac{1}{2}ZnCl_2$ | 2 g |
| saponin | 0.1 g |

Subsequently, by coating this liquid on a white stencil paper for diazo copying material and drying thereafter, there was obtained a binary diazo copying material A. When this copying material was superposed on an original having an appropriate image, exposed to a fluorescent light of 160 W for about 4 seconds and thereafter developed with a liquid developer 1 having the following composition, there was formed a genuine black dye image.

| | |
|---|---|
| liquid developer 1 (pH value: 12.0): | |
| water | 100 ml |
| potassium carbonate | 2 g |
| potassium metaborate | 8 g |

When the same copying material was exposed to light in the same way as above and thereafter developed with ammonia by the use of a commercial dry diazo copying machine, there was formed a black dye image like in the case of the wet developing.

Further, when the same copying material was exposed to light in the same way as above and thereafter developed with a liquid developer 2 having the following composition using a commercial semi-dry diazo copying machine, there was formed a genuine black dye image like in the foregoing case.

| | |
|---|---|
| liquid developer 2: | |
| monoethanol amine | 15% by weight |
| diethylene glycol monomethyl ether | 50% by weight |
| ethylene glycol | 35% by weight |

Next, for the purpose of comparing with general yellow-developing couplers, another binary diazo copying material B was prepared by replacing Compound (I) with the same amount of acetoacetoanilide in the present example. After exposing this copying material to light in the same way as in the present example, by developing it by the foregoing 3 varieties of developing process, there was formed a black dye image respectively.

When the thus obtained samples were subsequently subjected to forced light fastness test for 3 hours by means of a commercial fade meter, it was confirmed that the copying material A of this invention can manifest a superb light fastness compared with the comparative copying material B as shown in the following Table-1.

TABLE-1

| Developing process | Sample | before test color tone | before test image density | after test color tone | after test image density |
|---|---|---|---|---|---|
| wet process | A | black | 1.25 | black | 1.20 |
| | B | black | 1.24 | bluish purple | 0.95 |
| dry process | A | black | 1.28 | black | 1.24 |
| | B | black | 1.29 | bluish purple | 0.93 |
| semi-dry process | A | black | 1.18 | black | 1.05 |
| | B | black | 1.20 | bluish purple | 0.72 |

(The density of image was measured by Macbeth densitometer, the manufacture of Macbeth Co. of U.S.A.).

EXAMPLE 2

A photosensitive layer forming liquid was prepared by mixing the following ingredients:

| | |
|---|---|
| water | 100 ml |
| concentrated sulfuric acid | 1 ml |
| theophylline | 1 g |
| magnesium sulfate | 1 g |
| afoesaid Compound (II) | 1 g |
| 4-diazo-2,5-dibutoxyphenyl morpholine chloride . $\frac{1}{2}ZnCl_2$ | 3 g |

-continued

| | |
|---|---|
| saponin | 0.1 g |

Subsequently, by coating this liquid on a thick tracing paper and drying thereafter, there was obtained a binary diazo copying material C. When this copying material was exposed to light according to the procedure described in Example 1 and thereafter developed with the liquid developer 1, liquid developer 2 and ammonia gas, respectively, by the use of the wet, dry and semi-dry copying machine, respectively, there was formed an orange-yellow dye image of equal degree in each case. This image proved excellent in ultraviolet-interceptivity, and was well useful as a secondary original.

Meanwhile, for the purpose of comparing with general yellow-developing couplers, another binary diazo copying material D for use as a comparative secondary original was prepared by replacing Compound (II) with the same amount of acetoacetonaphthalide in the present example. Next, by developing this copying material by 3 varieties of developing process in the same way as in Example 1, there was obtained an orange-yellow dye image respectively.

When the thus obtained samples were subsequently subjected to forced light fastness test for 3 hours by means of a fade meter, it was confirmed that the copying material C of this invention can manifest a superb light fastness compared with the comparative copying material D as shown in the following Table-2.

TABLE-2

| Developing process | Sample | before test color tone | before test image density | after test color tone | after test image density |
|---|---|---|---|---|---|
| wet process | C | orange-yellow | 0.73 | orange-yellow | 0.71 |
| | D | orange-yellow | 0.71 | orange | 0.52 |
| dry process | C | orange-yellow | 0.76 | orange-yellow | 0.71 |
| | D | orange-yellow | 0.78 | orange | 0.49 |
| semi-dry process | C | orange-yellow | 0.62 | orange-yellow | 0.59 |
| | D | orange-yellow | 0.58 | orange | 0.37 |

EXAMPLE 3

A precoating layer forming liquid was prepared by mixing the following ingredients:

| | |
|---|---|
| water | 100 ml |
| fine-particle corn starch (particle diameter: 1 to 5 $\mu$) | 2.5 g |
| polyvinyl acetate emulsion (solid content: 50%) | 5 g |
| naphthalene-2,4-disodium sulfonate | 1 g |
| Methylene Blue | 0.003 g |

A photosensitive layer forming liquid was also prepared by mixing the following ingredients:

| | |
|---|---|
| water | 100 ml |
| citric acid | 2 g |
| caffeine | 1 g |
| aluminum sulfate | 1 g |
| aforesaid Compound (III) | 0.2 g |
| 2-hydroxy-3-napthoic acid ethanol amide | 0.5 g |
| 4-diazo-N,N-dimethylaniline chloride . $\frac{1}{2}ZnCl_2$ | 2.4 g |
| zinc chloride | 10 g |

-continued

| | |
|---|---|
| saponin | 0.1 g |

Next, after forming a precoating layer on a white stencil paper for diazo copying material by coating the foregoing precoating layer forming liquid thereon and drying, the foregoing photosensitive layer forming liquid was coated on said precoating layer and dried thereafter, whereby there was prepared a binary diazo copying material. When the thus obtained copying material was exposed to light in the same way as in Example 1 and developed by the respective developing processes, there was formed a genuine black dye image having a high density and an excellent light fastness.

EXAMPLE 4

A photosensitive layer forming liquid was prepared by mixing the following ingredients:

| | |
|---|---|
| water | 80 ml |
| ethylene glycol | 10 ml |
| tartaric acid | 3 g |
| zinc chloride | 2 g |
| 2,3-dihydroxy-6-sodium sulfonate | 1 g |
| aforesaid Compound (IV) | 0.3 g |
| 4-diazo-2,5-diethoxymorpholine chloride . $\frac{1}{2}ZnCl_2$ | 1.6 g |
| colloidal silica (particle diameter: 1 $\mu$) | 2 g |
| saponin | 1 g |

Next, after forming a precoating layer on a white stencil paper by coating the same precoating layer forming liquid as in Example 3 thereon and drying, the foregoing photosensitive layer forming liquid was coated on said precoating layer and dried thereafter, whereby there was prepared a binary diazo copying material. When the thus obtained copying material was exposed to light in the same way as in Example 1 and developed by the respective developing processes, there was formed a genuine black dye image having a high density and an excellent light fastness.

What is claimed is:

1. A diazo copying material comprising a support and a photosensitive layer, said photosensitive layer consisting essentially of a photosensitive diazonium compound and a yellow-developing coupler having the formula:

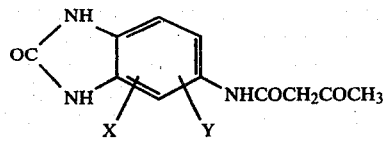

wherein X and Y are hydrogen, halogen, alkyl having 1 to 6 carbon atoms or alkoxy having 1 to 6 carbon atoms.

2. A copying material according to claim 1, wherein the amount of said yellow-developing coupler is in the range of from 0.01 to 5 moles per 1 mole of said photosensitive diazonium compound.

3. A diazo copying material comprising a support and a photosensitive layer, said photosensitive layer consisting essentially of a photosensitive diazonium compound, a yellow-developing coupler and a blue-developing coupler, said yellow-developing coupler having the formula:

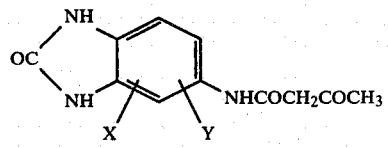

wherein X and Y are hydrogen, halogen, alkyl having 1 to 6 carbon atoms or alkoxy having 1 to 6 carbon atoms.

4. A copying material according to claim 3, wherein the amount of said yellow-developing coupler is in the range of from 0.01 to 5 moles per 1 mole of said photosensitive diazonium compound.

5. A copying material according to claim 3, wherein said blue-developing coupler is a $\beta$-naphthol derivative.

* * * * *